United States Patent [19]

Tolotti

[11] 4,266,526

[45] May 12, 1981

[54] FIREPLACE HEATER

[76] Inventor: Gregory Tolotti, 35 N. Edison, #20, Reno, Nev. 89502

[21] Appl. No.: 39,554

[22] Filed: May 16, 1979

[51] Int. Cl.[3] ..... F24B 7/00

[52] U.S. Cl. ..... 126/123; 126/138; 237/51

[58] Field of Search ..... 126/120, 121, 123, 126, 126/131, 136, 66, 65, 77, 192, 193, 138, 139, 60, 140, 143, 110 A; 237/51; D23/94

[56] References Cited

U.S. PATENT DOCUMENTS

| | | | |
|---|---|---|---|
| 803,938 | 11/1905 | Thompson | 126/138 X |
| 974,290 | 11/1910 | Merritt | 126/60 |
| 2,642,859 | 6/1953 | Brown | 126/121 |
| 2,743,720 | 5/1956 | Dollinger | 126/121 |
| 2,747,568 | 5/1956 | Dupler | 237/51 X |
| 3,162,188 | 12/1964 | Tompers | 126/140 |
| 3,616,788 | 11/1971 | Hannebaum | 126/138 |
| 3,834,619 | 9/1974 | Glover | 126/121 X |
| 3,913,558 | 10/1975 | Caldwell | 126/139 |
| 3,993,040 | 11/1976 | Antone | 126/60 |
| 4,015,581 | 4/1977 | Martenson | 126/123 X |
| 4,068,650 | 1/1978 | Nelson | 126/121 |
| 4,095,581 | 6/1978 | Billmeyer et al. | 126/143 X |
| 4,111,182 | 9/1978 | Roberts et al. | 126/66 X |
| 4,131,105 | 12/1978 | Moncrieff-Yeates | 126/131 X |

*Primary Examiner*—Samuel Scott
*Assistant Examiner*—Randall L. Green
*Attorney, Agent, or Firm*—Schwartz, Jeffery, Schwaab, Mack, Blumenthal & Koch

[57] ABSTRACT

The fireplace heater is adapted to be placed in a normal fireplace opening and functions as a heat exchanger through which room air is passed for indirect heat exchange with the combustion products. The heater includes a firebox which is mounted on a front frame member, and an outer frame or wrapper which is spaced throughout from the firebox to provide channels or passages through which the room air is directed for heating the same. The front of the heater includes side and top panels which are constructed and arranged to provide an airtight assembly.

13 Claims, 8 Drawing Figures

FIREPLACE HEATER

BACKGROUND OF THE INVENTION

The present invention relates as indicated to a fireplace heater, and relates more particularly to an airtight heater which can be placed in preexisting fireplace openings. The purpose of the invention is to use to the extent possible the heat developed in the firebox and return the same to the room for heating the same, as contrasted with normal fireplace constructions in which a substantial amount of the heat of combustion is passed upwardly into the chimney flue.

Various types of fireplace heaters are known in the prior art, with all of these operating on the basic principle of drawing room air into the heater in heat exchange with the combustion gases of the fireplace, and thereafter returning the heated room air to the room. A typical heat exchanger of this type is disclosed in U.S. Pat. No. 4,091,794 to James J. Stites, with the heat exchanger disclosed therein comprising a plurality of tubes which envelope the area of heat in the fireplace and through which air drawn from the room is forcibly passed and returned to the room following the heat exchange. Air is forced through the tubes from a header connected to a fan, and the heat exchange is solely through the heater tubes thereby resulting in substantial heat loss through the chimney flue. An exterior frame including doors is mounted over the sides and top of the hearth.

U.S. Pat. No. 4,096,849 to Moncrieff-Yeates discloses a fireplace heating unit which can be positioned in the fireplace opening, with room air passing by natural convection through channels outside of the firebox for heat exchange therewith prior to returning to the room. The unit is entirely open to the room at the front, and air is not forcibly directed through the channels around the firebox.

U.S. Pat. Nos. 4,117,827 and 4,004,731 also relate to heat exchange units which can be positioned in fireplace openings to place room air in indirect heat exchange with the products of combustion of the fireplace.

SUMMARY OF THE INVENTION

The invention comprises a heat exchange unit which can be installed in a normal fireplace opening for heating room air in indirect heat exchange with the combustion products, after which the heated air is returned to the room. In accordance with the invention, a separate firebox is secured to a front frame member, with such frame member serving to close the front of the firebox except for the provision of doors, preferably made of glass, which, when closed, restrict the passage of the combustion products through an opening in the top of the firebox. A damper mounted either above or below the doors serves to adjustably control room air passing to the firebox, with such air being directed downwardly over the glass for maintaining the inner surfaces thereof as clean as possible in view of the firebox combustion products.

The invention further comprises an outer frame or wrapper which is disposed around the firebox and spaced therefrom at the top, back, bottom and sides of the firebox. Room air is directed, preferably under fan pressure, through the bottom channel between the firebox and outer frame, up the back and side channels and through the top channel for return to the room. Since the air is in continuous contact with the bottom, back, side and top walls of the firebox, substantial heat is exchanged before the room air is returned to the room. The spacing between the bottom wall of the firebox and the bottom wall of the outer frame is sufficiently great at the front of the unit to accommodate at least one and preferably two fans and motors therefor which serve to draw room air into the channels or spaces between the firebox and the outer frame. The bottom channel narrows from the relatively wide spacing at the front thereof, with the spacing at the end of the bottom channel and at the back, top and sides being relatively uniform, for example, approximately one inch.

A further feature of the invention is the provision of side and top panels at the exterior of the unit, which serve an aesthetic role in addition to sealing the unit at the sides and top. The side panels are preferably rearwardly flanged at least at the sides and top to define a cavity into which insulation can be placed so that when the panels are installed around the unit, the mounting of the panels relative to the fireplace wall surrounding the opening is sealed. This guards against heat loss at the sides of the unit and provides a relatively airtight heat exchanger, with the only inlet to the firebox when the doors are closed being the adjustable damper disposed either above or below the doors. The amount of room air admitted to the firebox for optimum combustion can be closely regulated by the damper as will be described.

A further feature of the invention is the provision of leveling means operatively connected to the outer frame of the unit by means of which the unit can be leveled relative to the fireplace hearth. The leveling means can also ensure a tight fit of the unit within the fireplace opening.

These and other objects of the invention will be apparent as the following description proceeds in particular reference to the application drawings.

BRIEF DESCRIPTION OF THE APPLICATION DRAWINGS

Figure 8:
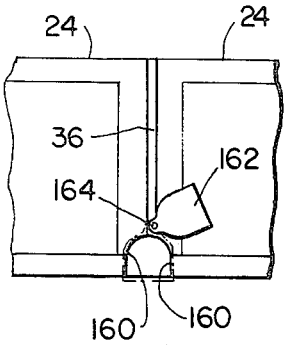
Figure 6:
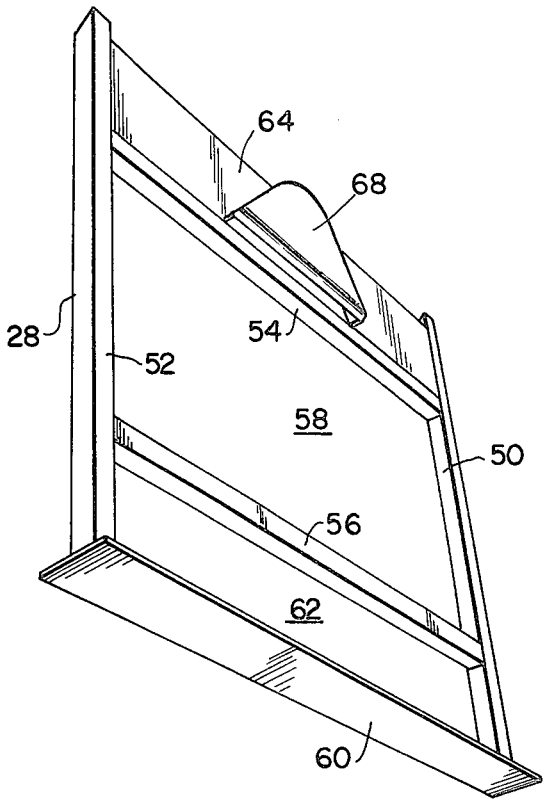
Figure 7:
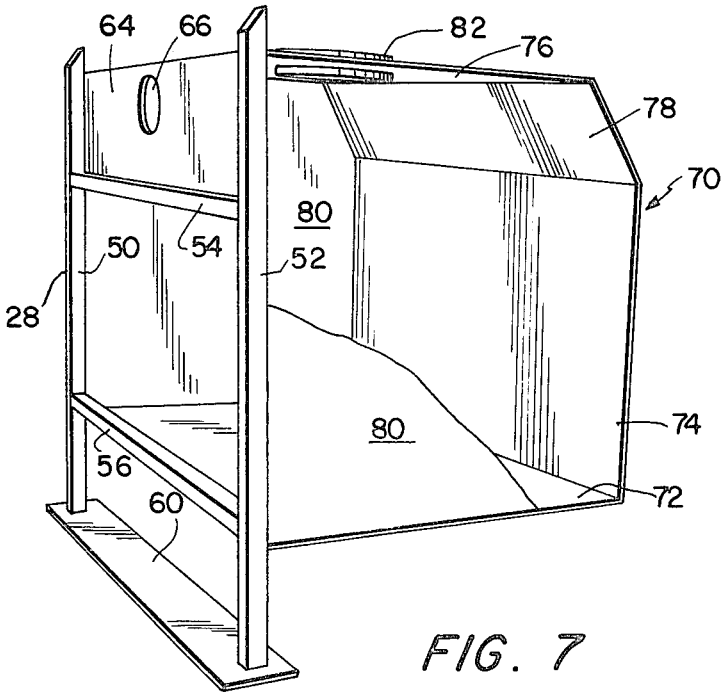

FIG. 6 is a perspective view of the back of the front frame member to which the firebox is secured; and, FIG. 7 is a perspective view of the front frame and firebox, with the front sidewall of the latter being partially broken away to show the interior construction and exhaust duct mounted in the top wall of the firebox, and FIG. 8 is a fragmentary front elevational view of a modified form of the invention in which the doors collectively define a bottom opening which can be opened during starting of the fire and closed by a plate thereafter.

DETAILED DESCRIPTION OF THE PREFERRED EMBODIMENTS

Figure 1:
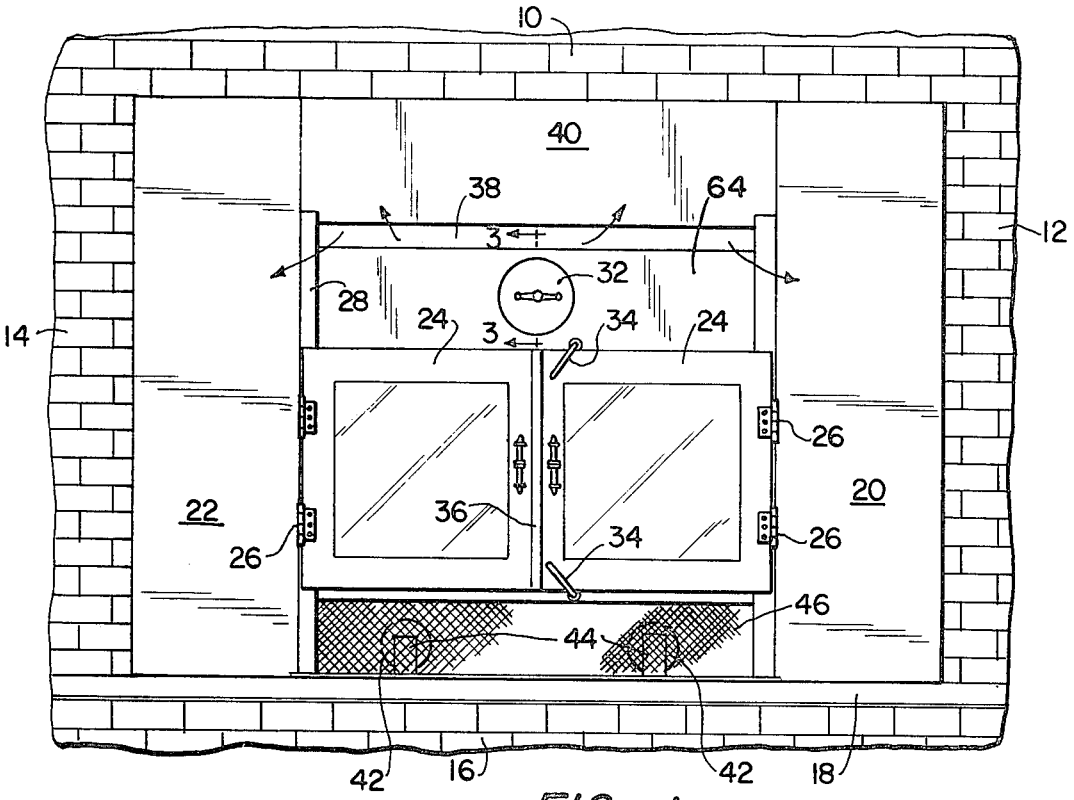
FIG. 1 is a front elevational view of the fireplace heater, fully installed.

Referring now to the application drawings, wherein like parts are indicated by like reference numerals, and initially to FIG. 1, there is illustrated therein the fireplace the heater in a fully installed position in the fireplace opening defined by walls 10, 12, 14 and 16. In the usual manner, a hearth 18 is provided, and the bottom of the fireplace heater in accordance with the present invention rests on the bottom of the fireplace chamber parallel with the surface of the hearth. The above-described structure is typical of fireplace construction and has been described only for the purpose of more clearly understanding the present improvements.

Those components of the fireplace heater visible in FIG. 1 include side decorative panels 20 and 22, which extend from the hearth to the top of the heater; doors 24 which are hinged as commonly shown at 26 to a front frame member 28 only part of which is visible in FIG. 1. The front frame includes a solid plate 64 which is apertured to permit room air to enter the combustion chamber through an adjustable damper 32, the details of which are illustrated more clearly in FIG. 3. Latch members 34 are pivotally secured to the front frame and extend downward over the door 24 shown at the right in FIG. 1 to retain the same in the closed position. The doors are preferably constructed so that the door 24 is provided with a sealing flange 36 which over-laps the adjoining edge of the door shown at the left in FIG. 1 when both doors are closed, after which the latches can be moved to their FIG. 1 position.

A slot 38 is defined by the top of the plate 30 of the front frame and a top plate 40 of an outer frame or wrapper which will be described in more detail hereinbelow. It will be noted that the top surface of the plate 40 is aligned with the top of the decorative panels 20 and 22 thereby to form an attractive, completed unit.

Also shown in FIG. 1 somewhat diagrammatically are fan members commonly designated at 42 which are driven by motors 44, with the motors and fans being hidden by a screen 46 which is positioned in an opening provided therefor in the bottom portion of the front frame member 28. The screen 46 can be made, for example, of expanded metal so as to provide an attractive appearance while at the same time hiding from view the fans 42. The fans are preferably thermostatically controlled, being actuated automatically when the firebox temperature rises, and shutting off when the firebox temperature cools.

The front frame 28 and firebox are shown in more detail in FIGS. 6 and 7 and reference is made thereto. The frame 28 includes side posts 50 and 52, and transverse posts 54 and 56 which define an opening 58. It is this opening which receives the doors 24 as shown in FIG. 1. A bottom plate 60 is secured to the posts 50 and 52, and a further opening is provided between the intermediate posts 56 and the bottom plate 60. It is in the opening 62 which the screen 46 is positioned.

Figure 3:
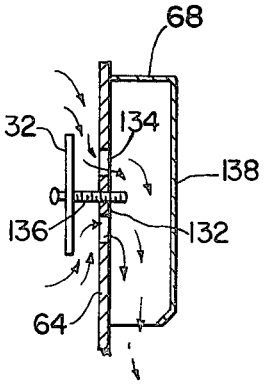
FIG. 3 is a sectional view taken on line 3—3 of FIG. 1, showing in detail the adjustable damper assembly for admitting room air to the combustion chamber.

The frame 28 further includes a top plate 64 which is apertured as shown at 66, with the back face of the plate 64 having welded or otherwise secured thereto a flow director 68, the purpose of which will become more apparent when particular reference is made to FIG. 3.

Referring to FIG. 7, the firebox is generally indicated at 70 and includes a bottom wall 72, a back wall 74, a top wall 76, and an inclined wall section 78 separating the latter, and two sidewalls commonly designated at 80, with the near sidewall 80 being shown fragmentarily in FIG. 7. The front edges of the bottom wall 72 and top wall 76 are welded or otherwise secured to the front frame 28 to form an integral unit therewith.

The walls of the firebox 70 are preferably formed of plate steel, and more preferably of plate steel of 3/16 inch or $\frac{1}{4}$ inch in thickness.

Figure 2:
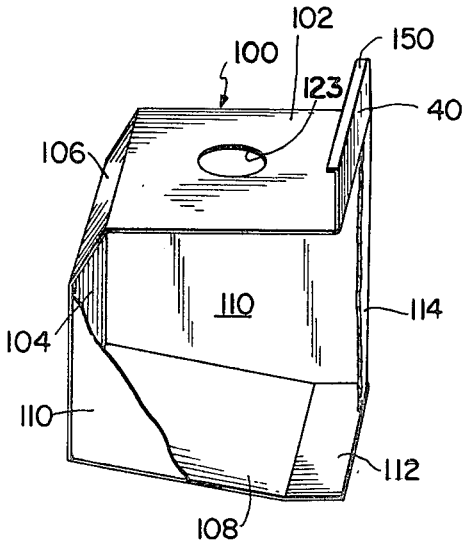
FIG. 2 is a perspective view of the outer frame or wrapper, showing the top, back and bottom walls, with the front being partially removed for clarity.
Figure 4:
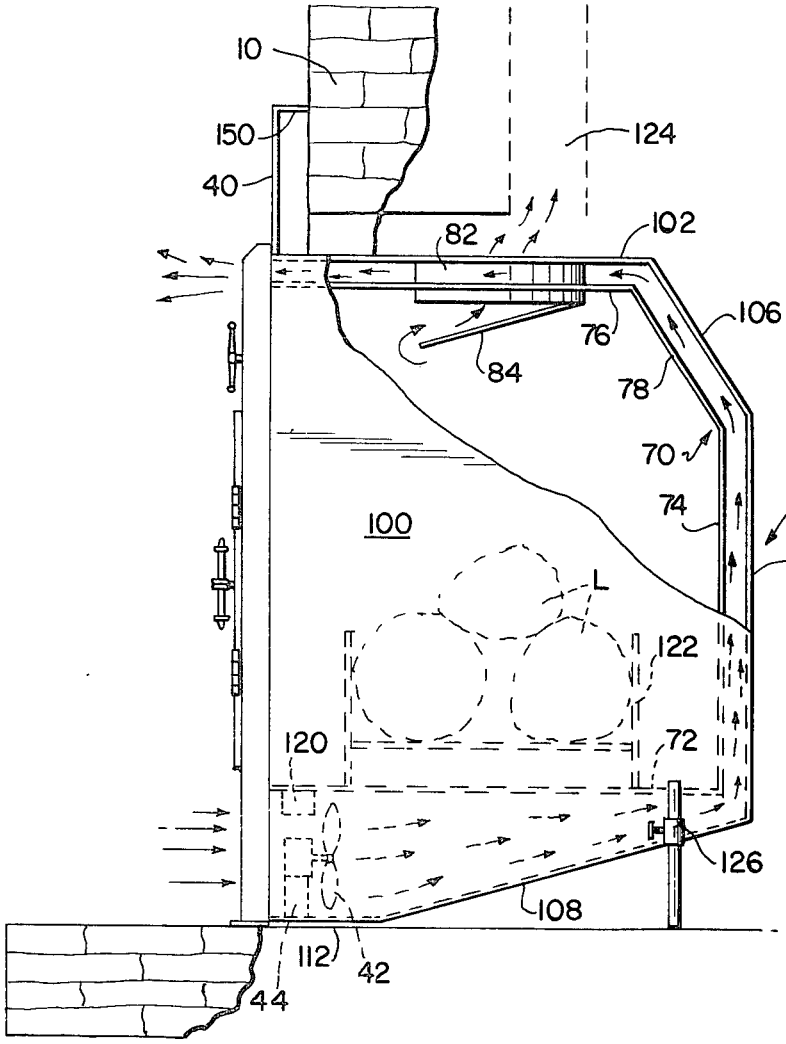
FIG. 4 is a side elevational view, partly broken away and partly fragmentary, showing the assembled relationship of the inner frame or firebox and the outer frame or wrapper.

An opening is formed in the top wall 76 of the firebox, and a flue pipe 82 is mounted in the opening. Approximately one inch of the pipe extends into the firebox, with a portion of the pipe extending upwardly from the top surface of wall 76 for contact engagement with an outer frame member positioned around the firebox, as will be presently described. The flue pipe 82 serves as the sole opening from the combustion chamber to the flue chimney, and can be provided with a damper 84 (FIG. 4) to adjustably control the combustion gases passing to the chimney flue. By controlling the combustion gas exhaust and the room air fed to the firebox, heat exchange can be maximized. Referring to FIGS. 2 and 4, an outer frame or wrapper generally indicated at 100 is disposed around the firebox and spaced therefrom at the sides, bottom, back and top. The spacing at the bottom, back and top is readily evident from FIG. 4, and it will be understood that the sidewalls of the outer frame 100 are similarly spaced from the sidewalls 80 of the firebox, thereby to provide channels around the entire firebox.

As shown in FIG. 2, the outer frame or wrapper includes a top wall 102, a back wall 104, a connecting inclined wall portion 106, bottom wall 108 and sidewalls commonly designated at 110, with the near sidewall 110 being shown fragmentarily in FIG. 2. The bottom wall 108 is inclined relative to the horizontal (see FIG. 4), and terminates at the front thereof with a front section 112 which is generally parallel to the top wall 102. Each sidewall includes a narrow, inwardly directed flange 114 at the forward edge thereof, with such flange 114 serving to bridge the gap between the sidewalls 110 and the posts 50 and 52 which form part of the frame 28. In this manner, leakage at the front of the unit, when the firebox and the outer frame are assembled, is prevented.

FIG. 4 clearly shows the spatial relationship between the firebox 70 and the outer frame or wrapper 100. It will be seen that circulating channels for room air are provided at the bottom, back and top of the unit, and as previously described, the same spaced channels are also provided at the sides. It will be noted that the bottom wall 72 of the firebox is substantially horizontal, whereas the primary portion 108 of the bottom wall of the outer frame is inclined downwardly and forwardly, terminating in a relatively short horizontal section 112. The purpose of such arrangement is to provide space for the fans 42 and the fan motors 44. The bottom channel gradually narrows and at the rear portion thereof, it is substantially the same in width as the channels formed between the back and top walls of the firebox and outer frame, respectively.

As above-noted, the fans 42 are preferably thermostatically controlled, and a thermostat is diagrammatically illustrated at 120, mounted on the bottom wall 72 of the firebox. It will be understood that the thermostat can be mounted in any desired location including disposition within the firebox as long as the thermostat is out of direct contact with the combustion gases. When the firebox temperature reaches a predetermined temperature level, for example, 130° F., the fans 42 will be actuated to forcibly direct air through the channels between the firebox and the outer frame. Although not illustrated, it will be understood that the thermostat is included in the electrical circuitry for the fan motors, with a conventional electrical cord extending from one or both of the fan motors for placement into an electrical socket for providing current for the motors.

A grate is diagrammatically illustrated at 122 in FIG. 4, on which logs L are positioned. The bottom of the grate rests directly on the bottom wall of the firebox 72, and the front of the grate is preferably positioned a minimum distance from the glass doors 24 to keep the latter as clean as possible.

As previously described, the flue pipe 82 extends through an opening in the firebox and also an opening 123 (FIG. 2) in the top wall 102 of the outer frame 100. The top of the pipe is preferably coplanar with the top surface of the wall 102. The combustion gases are therefore directed from the combustion chamber in the firebox through the flue pipe 82 to the chimney flue 124, shown in dotted lines in FIG. 4. A damper is not shown with the chimney flue 124, and once the fireplace heater is installed, the damper is preferably maintained in open position, with the airtight installation of the unit precluding the necessity for closing the chimney damper. As previously described, the flue pipe 82 is provided with a damper 84 which can be adjusted in position to control the egress of the combustion gases from the firebox. The flue pipe 82 is sealed in the openings provided therefor in the top walls 76 and 102 so as to preclude the combustion gases from commingling with the room air prior to reentry into the room, as shown by arrows in FIG. 4.

Figure 5:
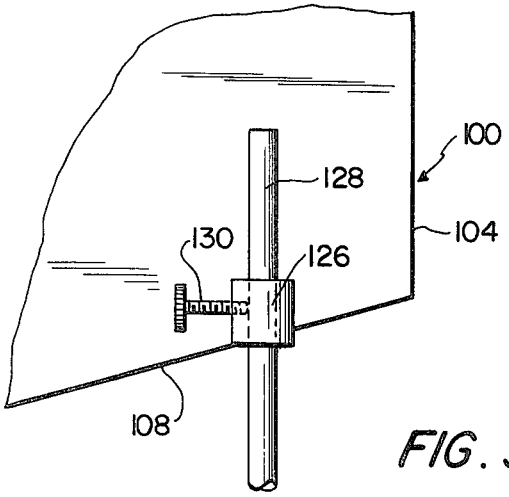
FIG. 5 is an enlarged view of the leg adjustment mechanism operatively connected to the outer frame for leveling the same.

The outer frame 100 is also preferably formed of sheet steel, and welded or otherwise secured to the front frame 28 thereby to provide a rigid assembly with the front frame and with the firebox 70, the latter being in properly spaced position relative to the outer frame. In order to level the unit during installation, a bracket 126 is provided on each sidewall 110, with a leveling rod 128 (FIG. 5) extending downwardly through an opening in the bracket. A set screw 130 maintains the rod 128 in its adjusted position, with such adjustment preferably being such as to render horizontal the bottom wall 72 of the firebox. The bottom of the foot 128 engages the bricks or other supporting surfaces forming the bottom of the fireplace chamber.

Referring to FIG. 3, there is illustrated in more detail the flow director 32 and the adjustable damper 32. As shown in FIG. 7, an opening 66 is formed in the top plate 64 of the front frame member, and an apertured disc 132 is mounted in the opening. The disc includes a series of circumferentially spaced vent openings 134 through which the room air can enter the flow director, as shown by arrows in FIG. 3. The damper includes a threaded rod 136 which engages a threaded opening formed in the disc 132, whereby the distance of the disc 132 from the front plate 64 can be varied. In the spacing of the disc 132 as shown in FIG. 3, room air substantially unimpeded can enter through the openings 134 and downwardly through the flow director 63 into the combustion chamber. When the disc 132 is moved toward the plate 64, the flow of air through the director 63 is restricted. In this manner, combustion air can be regulated to provide optimum burning conditions. In lieu of the disc 132, vent openings can be drilled through the plate 64, and a tapped opening provided for the rod 136.

As will be seen in FIG. 6, the flow director 63 is generally triangular shaped, the purpose of which design is to permit the incoming room air to flow down over the inside of the glass doors 24, thereby providing a curtain of air to minimize contact of the combustion gases with the glass. In this manner, the glass can be kept as clean as possible, thereby enhancing the aesthetic effect of the unit. The flow director 63 can be secured to the back side of the plate 64 by welding or the like.

Although not illustrated in the application drawings, the side panels 20 and 22 are preferably formed with rearwardly extending flanges at the sides and top thereof thereby to define a cavity into which insulation can be placed. The side flanges adjacent the front frame 28 are formed with a plurality of spaced openings through which fastening screws can extend into engagement with aligned openings in the posts 50 and 52 of the side frame. When the unit is moved toward the fireplace chamber during final installation of the unit, the insulation contacts the walls surrounding the fireplace opening thereby serving to seal the panels and preventing lateral flow of the heated air through the juncture of the panels with the fireplace wall. The heated air is thus confined to the top channel between the top walls 76 and 102. As previously described, the outer frame 100 is formed with an upwardly directed flange 40 which terminates in a rearwardly directed flange 150, the rear face of which engages the wall 10 when the unit is installed, as shown in FIG. 4. The height of the flange 40 is such that when the unit is installed, the upper edge thereof is preferably in the same plane as the upper ends of the panels 20 and 22 thereby to provide an attractive frame at the exterior of the fireplace heater. Insulation is preferably placed behind the flange 40.

The installation and operation of the invention should be apparent from the above description. The firebox 70 is initially secured by welding or the like to the front frame member 28. The outer wrapper 100 is thereafter secured around the firebox, and also secured by welding or the like to the front frame. The doors are installed on the unit, as are the fan motors and fans, and the damper 32 and flow director 63. The unit will normally be shipped with the panels 20 and 22 in place, and the panels are normally temporarily removed while the unit is moved into the fireplace chamber. The rods 128 are then adjusted to level the unit, after which the unit is moved outwardly and the panels 20 and 22 secured in place. The entire unit is then moved inwardly until the panels 20 and 22, and the top flange 40 tightly engage the walls surrounding the fireplace opening. The unit is then installed and ready for operation.

Referring to FIG. 8, there is illustrated therein a modification specifically designed to facilitate the starting of the fire with the doors 24 in a closed position. In the modification, each door is cut away at 160, with the arcuate cut away portions defining a generally semielliptical composite opening. A closure slide 162 is pivotally connected as shown at 164 to the door 24 shown at the right in FIG. 8, with the slide being shown in an open position in FIG. 8 thereby exposing the opening and permitting room air to enter the fire chamber. When the slide 162 is moved to a closed position, it entirely covers the opening thereby preventing room air from entering the opening to support combustion. It will be apparent that in intermediate settings of the closure slide 162, varying amounts of air can be admitted through the opening to the fire chamber.

It has been shown that the closure arrangement in FIG. 8 greatly facilitates the starting of a fire by permitting room air to rush into the firebox generally at the level of the grate and wood positioned thereon thereby creating a bellows effect on the flame. The adjustable damper 32 (FIG. 3), which controls the only other entry area for room combustion air, can be regulated as desired with the closure slide 162, thereby providing optimum starting conditions. Normally, the damper during starting can be moved to a substantially closed position, and once the fire has been started, the closure slide 162 can be partially or entirely closed, and the damper adjusted outwardly to a partially or fully opened position. In addition to providing the indicated bellows effect on the flame, the bottom inlet opening and closure slide permit the doors 24 to be closed when the wood is ignited. This not only enhances the esthetic effects of the fireplace heater, but serves as a safety feature inasmuch as sparks are precluded from being thrown out into the room being heated.

To use the heater, the grate 122 within the firebox is loaded in the usual manner, and the wood started. At this point, the closure slide is normally entirely open to provide a rush of directionally controlled air to the fired wood. The damper 32 and the doors are normally closed. Once the fire is burning strongly, the closure slide 162 is partially or entirely closed and the damper control 32 can be adjusted at the desired position. When the firebox reaches a temperature of approximately 130 degrees F., the fans 42 will draw room air into the unit and pass the same through the channels surrounding the firebox, and return the heated air to the room through slot 38.

Due to the construction and assembly of the firebox and outer frame, and the side panels 20 and 22 and flange 40, the unit is very airtight thereby maximizing the heat exchange derived from the combusion products. The latter are passed from the combusion chamber up the flue pipe 82 to the chimney flue, as described. When the temperature drops back below 130 degrees F., the fans will automatically shut off. The operation of the fans serves not only to forcibly direct the heated air into the room, but also provides a cooling action on the exterior walls of the firebox and the interior walls of the outer frame. Such cooling action, together with the comparatively thick sheet metal employed for the firebox and outer frame provide a unit with lasting durability.

It will be apparent that the invention can be modified by those skilled in the art without, however, departing from the invention concepts. For example, the plate 30 and damper 32 could be mounted below the doors 24 rather than above as shown in the application drawings. In addition, a panel similar to panels 20 and 22 can be provided at the top of the unit, rather than the flange 40 formed at the upper end of the outer wrapper 100.

I claim:

1. A fireplace heater for room heating comprising:

(a) an inner frame including a front frame member and a firebox secured thereto, said firebox having top, side, back, and bottom walls defining the fire chamber;

(b) an outer frame comprising top, side, back, and bottom walls spaced respectively from the top, back, side and bottom walls of said inner frame to define bottom, top, side and back channels through which room air to be heated can pass, said outer frame also being secured to said front frame member and fitting within the fireplace opening;

(c) means for closing the front of said firebox including glass door means for gaining access to said fire chamber;

(d) first air inlet means in said front frame above said door means for admitting combustion air to said fire chamber, (e) flow director means mounted on said front frame behind and communicating with said first air inlet means, said flow director means being formed with downwardly and outwardly tapered side walls whereby the enlarged bottom portion of said flow director means serves to direct incoming room air downwardly across substantially the entire inside surface of said glass door means for maintaining the same clean, (f) second air inlet means formed in said frame below said door means and communicating with the channels between the bottom and side walls of said firebox and the adjacent spaced walls of said outer frame whereby room air to be heated is directed to said channels, and thereafter to said back and top channels, (g) damper means for adjustably controlling the admission of room air through said first air inlet means and said flow director for combustion purposes;

(h) air outlet means above said first air inlet means for returning heated air to said room, (i) fan means associated with one of said second air inlet means and said outlet means for forcibly directing room air to be heated through said channels, and (j) side panels positioned at the sides of said heater for covering the adjacent walls of said fireplace.

2. The combination of claim 1 wherein said flow director means is generally triangular shaped in cross-section.

3. The combination of claim 1 wherein said air outlet means is defined by the top of said front frame member of said inner frame and the bottom surface of the top wall of said outer frame.

4. The fireplace heater of claim 1, wherein the top walls of said firebox and said outer frame are formed with aligned openings through which a flue pipe extends for exhausting the combustion gases from the interior of the firebox, said flue pipe being sealed in said aligned openings whereby the air passing through said channels circulates around said pipe whereby combustion gases are not exhausted into the room.

5. The combination of claim 4 wherein said flue pipe is provided with a damper at the bottom end thereof which can be adjusted for controlling the egress of combustion gases through said pipe.

6. The fireplace heater of claim 1 wherein said fan means comprises a pair of fans mounted in the channel between the bottom wall of said firebox and the bottom wall of said outer frame, motor means for driving said fans, and wherein the bottom wall of said outer frame is spaced sufficiently apart from the bottom wall of said firebox at the front regions thereof to accommodate said fan means, with the bottom wall of said outer frame being inclined upwardly and rearwardly to form a tapered channel the rear end of which is generally comparable in width to the channels between the remaining walls of said firebox and said outer frame.

7. The fireplace heater of claim 6 further including a formaninous screen mounted at the bottom of said front frame member and serving to cover said fan means, and thermostat means mounted behind said screen for actuating said fan means when a predetermined temperature has been reached in said firebox.

8. The fireplace heater of claim 1, wherein said front frame member includes a top plate, said first air inlet means comprising a disc mounted in said plate and having spaced openings therethrough through which room air can pass to the fire chamber, said damper means comprising a damper member having a threaded rod adapted to threadably engage an opening formed centrally in said disc whereby said damper member can be rotated toward or away from said front plate to vary the spacing between said damper member and the openings formed in said disc, thereby controlling the air admitted into said flow director means and thus said fire chamber.

9. The fireplace heater of claim 1 further including means for leveling and supporting said outer frame member in the fireplace opening, comprising brackets mounted on the sidewalls of said outer frame and extending outwardly therefrom, a leveling rod extending downwardly through an opening provided therefor in each bracket, and means for retaining said leveling rod in its adjusted position, with the bottom of said rod contacting the floor of said fireplace chamber.

10. The fireplace heater of claim 1 wherein said front frame member comprises side posts and vertically spaced, transversely extending supporting posts which, with said side posts, define an opening for said doors, a top plate positioned above the uppermost transversely extending supporting post, and a bottom plate spaced from the lowermost transversely extending supporting post thereby defining an opening through which room air can be directed into said channels.

11. The fireplace heater of claim 1 wherein said side panels comprise panels formed with rearwardly extending side and top flanges which define with the face of said panel a cavity into which insulation is placed, with the installation of the heater into the fireplace serving to compress the insulation and thereby provide an airtight joint laterally outwardly of said front frame member, the interior flanged side of said side panels being secured to said front frame.

12. The fireplace heater of claim 1 wherein said outer frame further includes an upwardly directed front flange terminating in a laterally and rearwardly directed flange adapted to engage the adjacent fireplace wall when the fireplace heater is installed, with the upper surface of said flange being coplanar with the top surfaces of said side panels and the front surface of said front flanges being coplaner with the front surfaces of said side panels.

13. The fireplace heater of claim 1 wherein said door means comprise two doors each provided with an opening adjacent the lower, inner end thereof, with the openings jointly defining a third inlet opening through which room air can enter the fire chamber to enhance fire starting, and a closure plate pivotally connected to one of said doors, said closure plate being of a dimension to entirely cover said third opening when the fire has started, whereby the admission of room air for combustion purposes is entirely controlled by said damper means.

* * * * *